United States Patent [19]

DeSantis

[11] 4,376,744

[45] Mar. 15, 1983

[54] MECHANICAL AND FLUID ACTUATED RAM FOR POWDER COMPACTING PRESS AND METHOD OF COMPACTING POWDER MATERIAL

[75] Inventor: Raymond P. DeSantis, Troy, Mich.

[73] Assignee: PTX-Pentronix, Inc., Lincoln Park, Mich.

[21] Appl. No.: 323,725

[22] Filed: Nov. 23, 1981

Related U.S. Application Data

[60] Continuation-in-part of Ser. No. 183,011, Sep. 2, 1980, Pat. No. 4,302,412, which is a continuation of Ser. No. 14,311, Feb. 23, 1979, abandoned, which is a division of Ser. No. 798,823, May 20, 1977, Pat. No. 4,166,716.

[51] Int. Cl.[3] ..... B30B 11/02

[52] U.S. Cl. ..... 264/106; 425/78; 425/451.5; 425/593

[58] Field of Search ..... 264/109; 425/78, 355, 425/352, 451.5, 593, 167, 3

[56] References Cited

U.S. PATENT DOCUMENTS

| | | | |
|---|---|---|---|
| 3,345,691 | 10/1967 | Aoki | 425/593 X |
| 3,376,607 | 4/1968 | Brown | 425/593 |
| 3,687,586 | 8/1972 | Hara et al. | 425/78 |
| 3,767,351 | 10/1973 | Blaser | 425/167 X |
| 4,008,021 | 2/1977 | Fedrigo et al. | 425/3 |
| 4,166,716 | 9/1979 | DeSantis | 425/78 |
| 4,302,412 | 11/1981 | DeSantis | 425/78 |
| 4,316,712 | 2/1982 | Mendendorp | 425/593 X |

FOREIGN PATENT DOCUMENTS

| | | | |
|---|---|---|---|
| 390955 | 12/1973 | U.S.S.R. | 425/355 |

*Primary Examiner*—J. Howard Flint, Jr.
*Attorney, Agent, or Firm*—Hauke and Patalidis

[57] ABSTRACT

A powder compacting press provided with a mechanical toggle mechanism for reciprocating a ram disposed above the die supporting the table of the press, the pivotable support for the ram toggle upper connecting rod being connected to the movable member of a fluid cylinder. Fluid pressure in the cylinder urges the movable member to an extent limited by abutments, thus tending to displace the ram in a direction toward the table. The full force exerted on the ram by the toggle mechanism causes retraction of the fluid cylinder movable member until engagement of a second pair of abutment means cause the full force developed by the toggle mechanism to be exerted on the ram. The same cam is used for actuating the ram irrespective of whether the ram is used for clamping an anvil in position over a die cavity when the press is used in an anvil pressing mode, or for reciprocating upper punches, when the press is used in an opposed punch operating mode.

6 Claims, 6 Drawing Figures

MECHANICAL AND FLUID ACTUATED RAM FOR POWDER COMPACTING PRESS AND METHOD OF COMPACTING POWDER MATERIAL

CROSS-REFERENCE TO RELATED APPLICATIONS

The present application is a continuation-in-part of application Ser. No. 183,011, filed Sept. 2, 1980, now U.S. Pat. No. 4,302,412, issued Nov. 24, 1981, which was a continuation of application Ser. No. 014,311, filed Feb. 23, 1979, now abandoned, which was a division of application Ser. No. 798,823, filed May 20, 1977, now U.S. Pat. No. 4,166,716.

BACKGROUND OF THE INVENTION

The present invention relates to presses, more particularly powder compacting presses, provided with a reciprocable ram disposed above the press die supporting bed and to a method for compacting powder material by means thereof. More specifically, the invention relates to an improved mechanism for actuating the ram of a press and consisting of a combination of a mechanical toggle mechanism and fluid operated mechanism.

The present invention is an improvement on the presses disclosed in U.S. Pat. Nos. 3,826,599 and 4,166,716, assigned to the same assignee as the present invention. The presses disclosed in the aforesaid patents are provided with a ram disposed above the press bed in which is mounted a powder compacting apparatus comprising a die plate having one or a plurality of die cavities disposed therein. A punch is reciprocably disposed in each die bore and is actuated by the drive mechanism of the press by means, for example, of a power-driven camshaft and an appropriate cam follower driving the punch holder. A ram is reciprocably disposed above the press bed, therefore above the die plate, and is reciprocated in timed relationship with the reciprocation of the punch holder by an appropriate cam, cam follower, lever and toggle mechanism. A set of punches, each adapted to co-operate with a punch disposed in a die bore, can be mounted on the end of the ram and, or in addition, the ram, in its fully extended position, may be used to clamp over the die plate an anvil adapted to close the die cavity or cavities, and having a face overlapping the die cavity opening or openings, against which the powder material disposed in the die cavities is compacted by the punch or punches held in the die bore or bores. The anvil, together with a powder material dispenser and a finished part pick-up mechanism, is mounted on the end of a positioning arm, such as to be arcuately or linearly displaced and positioned over the die cavities in timed relationship with the die cavity filling step, the compacting step and the finished article ejection step. Such an arrangement of elements is described in the aforesaid patents and in U.S. Pat. Nos. 3,561,054 and 3,574,892, for example, of common ownership herewith.

The present invention is an improvement on the ram operating toggle mechanism disclosed in U.S. Pat. No. 4,166,716 and application Ser. No. 183,011, now U.S. Pat. No. 4,302,412, issued Nov. 24, 1981. In the aforementioned patents there is disclosed a mechanism providing a floating fluid pressure displaceable anchoring and pivoting point for the ram toggle mechanism, such that the ram may additionally be longitudinally displaced as a result of the reciprocation of the anchoring and pivoting point. Adjustable limit abutments are provided for the fluid actuated reciprocating anchoring and pivot point of the toggle mechanism, such that the stroke provided by the fluid actuated mechanism may be precisely determined, together with the extreme positions of the reciprocating member.

An arrangement is thus provided for compound reciprocation of a press ram and for precisely determining the extreme dwell positions of the ram. By thus providing a compound stroke of the press ram, part of the stroke being mechanically effected by a toggle mechanism and part of the stroke being pneumatically or hydraulically effected, the motion increments being either consecutive or simultaneous, according to the appropriate timing of the beginning and end of the two separately controlled motions, diverse results can be achieved.

One such result is that, in arrangements where the end of the arm is provided with a clamping mechanism for the positioner anvil, by proper timing of the clamping step pneumatic or hydraulic pressure may be exerted on the anvil prior to final mechanical clamping provided by the toggle mechanism, so that the clamping pressure applied on the anvil may be more progressive and is effected with a cushioning effect.

Another result is that, in structures comprising punches mounted on the end of the ram, such punches being adapted to penetrate into the die cavities and compact the material therein in the die bore between the end face of the ram mounted punches and the end face of opposedly reciprocating punches disposed in the die bore, compacting of the powder material can be effected in a more progressive manner as compared to methods using a mechanically actuated upper punch, and the density of the finished part is greatly improved as compared to the density of parts compacted under more conventional methods.

Because the dwell position of the ram and the force exerted by the ram are not the same when the ram is used for clamping an anvil over the die cavity or cavities and when the ram carries punches which are introduced into the die cavities for compacting the powder material between opposite punches, different cam contours are required for the cam actuating the toggle mechanism disclosed in U.S. Pat. Nos. 4,166,716 and 4,302,412, according to whether the press is used in an anvil press mode or an opposed punch mode. As the cam operating the toggle mechanism and the cam operating the lower punches are mounted on a common camshaft installed within the housing of the press apparatus below the table, changing cams is a lengthy and delicate operation resulting in substantial downtime in the operation of the press apparatus.

SUMMARY OF THE INVENTION

The present invention remedies the inconvenience of the prior art requiring the use of different cams for anvil pressing or for upper punch pressing in press apparatus of the type disclosed in the aforesaid patents. By providing a single cam for operating the toggle mechanism of the press, of particular contour such as to be capable of operating the toggle mechanism of the press whether the ram operated by the toggle mechanism is used as a clamping means for an anvil laterally or arcuately displaceable over the die cavity, or whether the ram carries a punch holder in which are mounted one or a plurality of upper punches for effecting compacting of articles in the die cavity between the opposing faces of the lower punches and the upper punches, the present invention remedies the only inconvenience of powder compacting presses whose ram is actuated by a toggle mechanism, and thus permits to operate such presses at their utmost efficiency rate.

Those and other advantages of the present invention will become apparent to those skilled in the art when the following description of the best mode contemplated for practicing the invention is read in conjunction with the accompanying drawing wherein like reference numerals refer to like or equivalent parts and in which:

DETAILED DESCRIPTION OF THE PREFERRED EMBODIMENT

Figure 1:
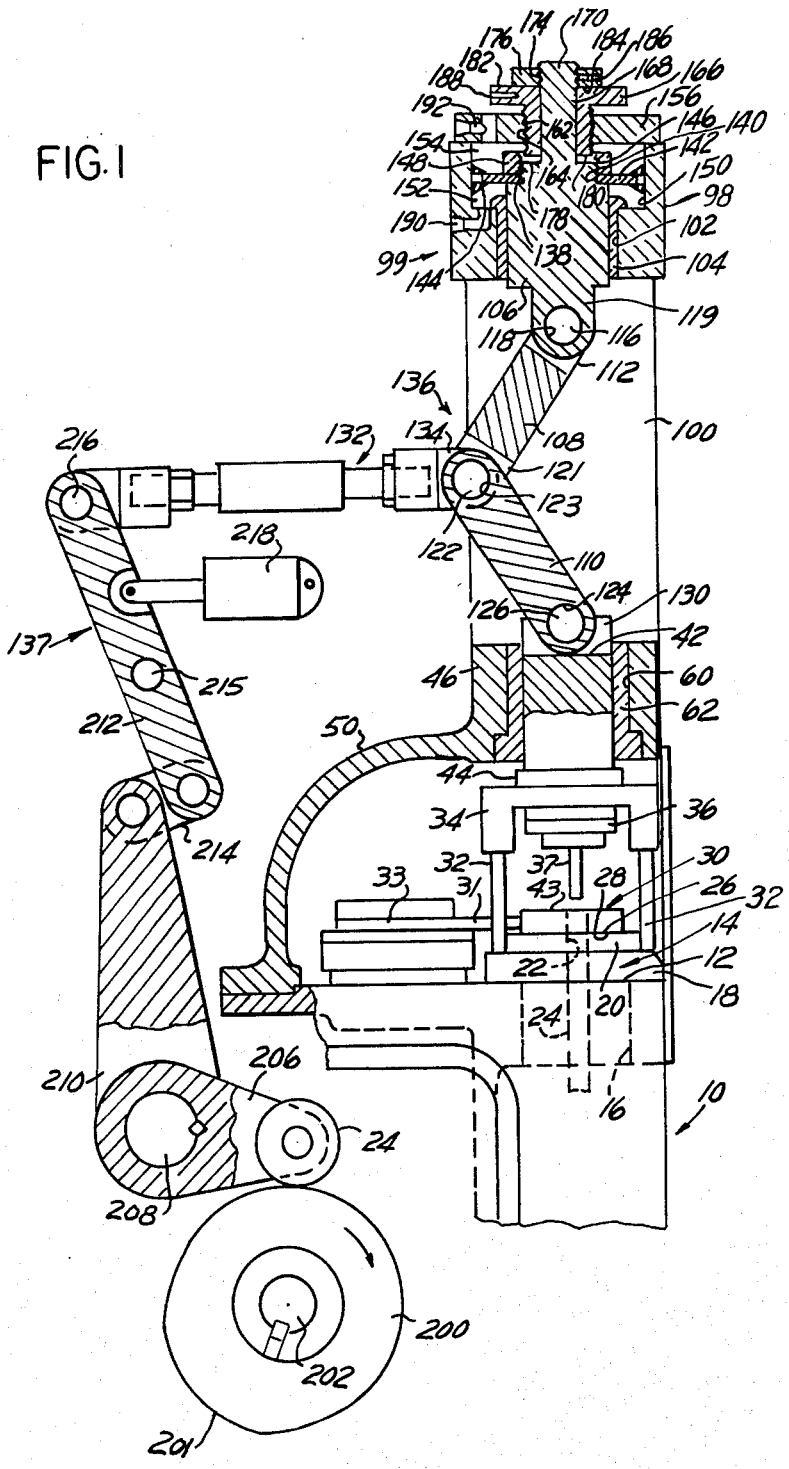
FIG. 1 is a side elevational view of a powder compacting press ram mechanism, according to the present invention, mostly in section with an upper punch mounted on the end of the ram, shown with the ram retracted prior to compacting powder material in a die cavity.

Referring to FIGS. 1–4, a press is illustrated as comprising a massive frame 10 including a table 12 supporting a punch and die assembly 14 disposed in an opening 16 of the table 12. The punch and die assembly 14 may be according to any one of the structures disclosed, for example, in U.S. Pat. Nos. 3,414,940, 3,561,056, 3,574,892, 3,726,622, 3,805,370 and 3,822,974, including a die plate spacer 18 bolted on the top of the plate 12. The die plate spacer 18 in turn supports a die plate 20 provided with one or more die bores 22 each having a vertically disposed reciprocating lower punch 24, reciprocable by the drive mechanism of the press, not shown.

Figure 3:
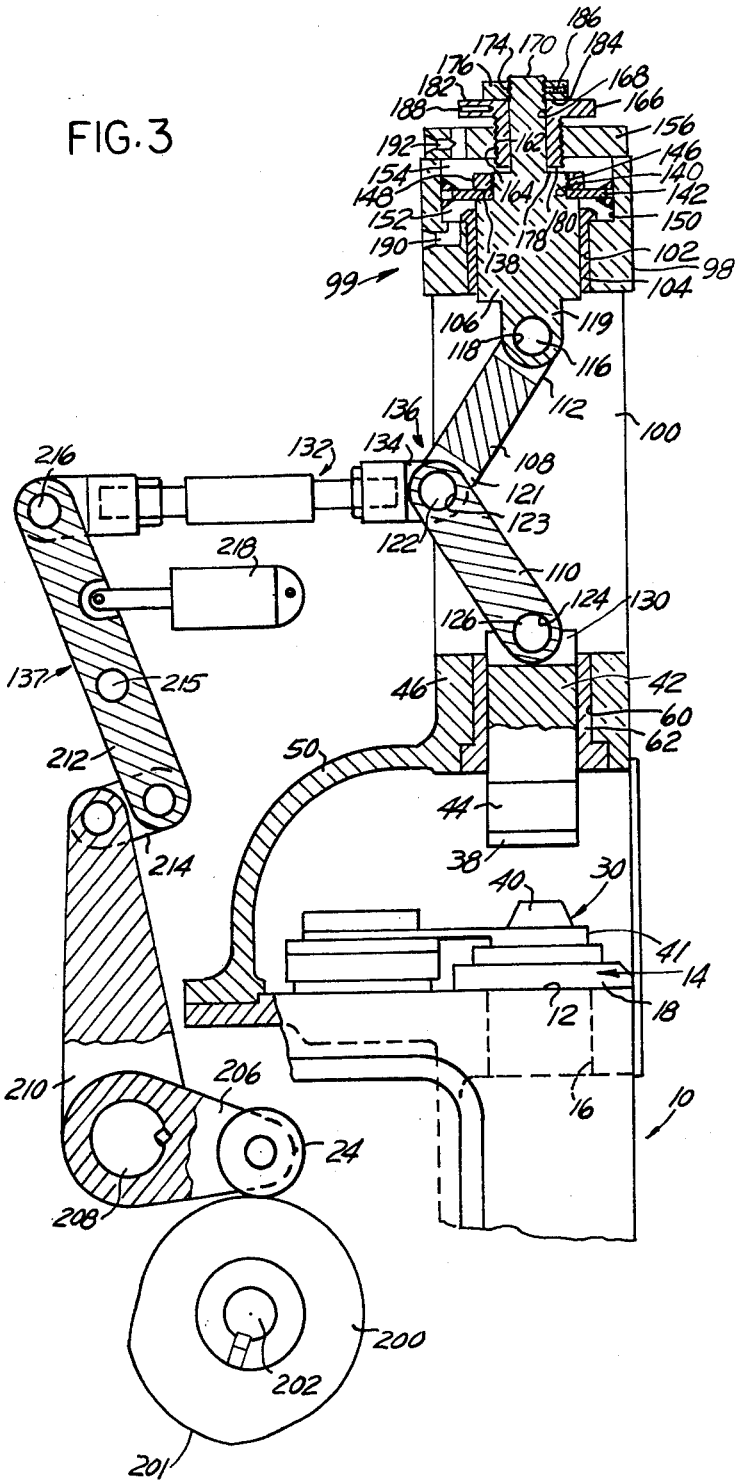
FIG. 3 is a view similar to FIG. 1, with an anvil clamp mounted on the end of the ram, shown during positioning of the anvil over the die cavity.
Figure 4:
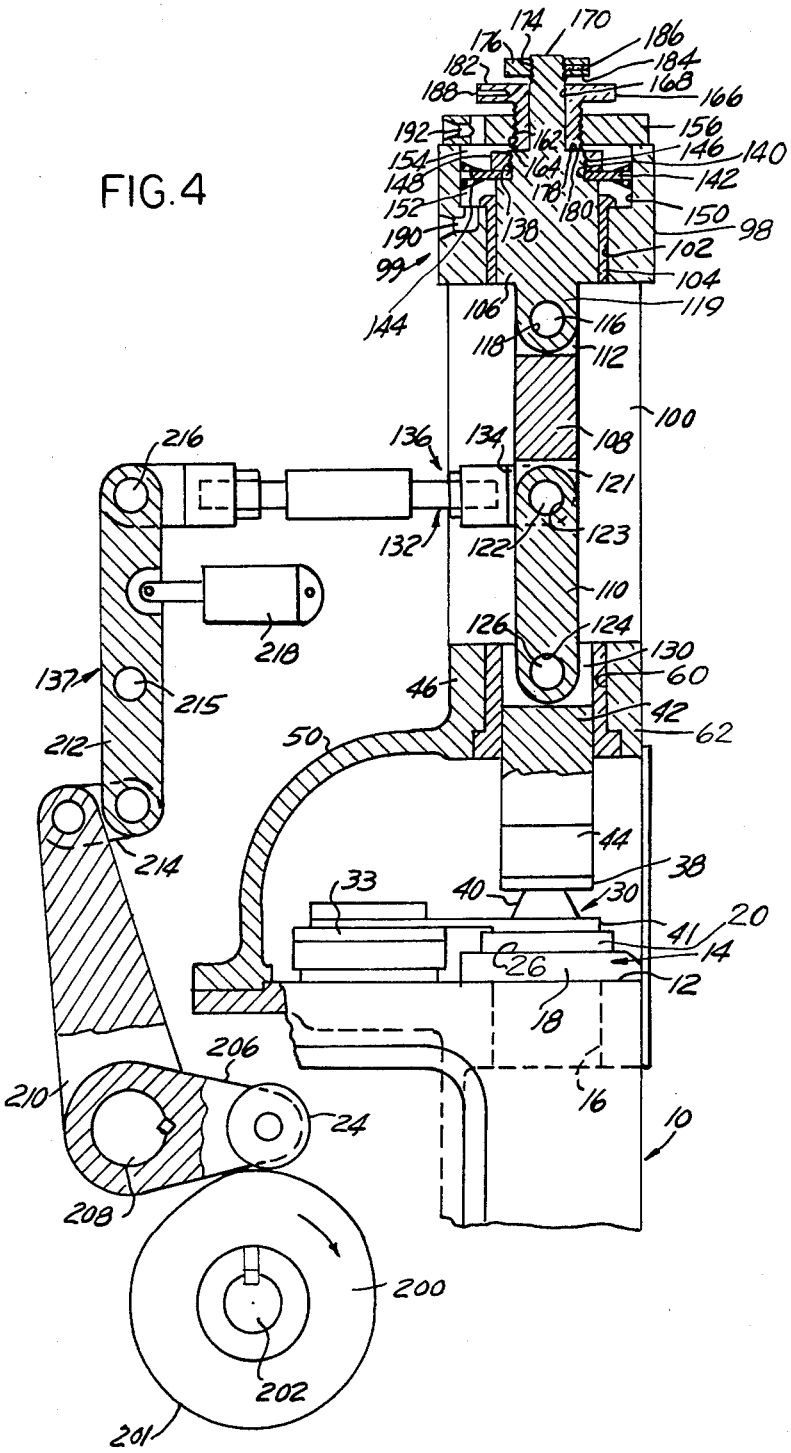
FIG. 4 is a view similar to FIG. 3, with the diverse elements shown at their position during press dwell.

The die plate 20 has an upper surface 26 slidably engaged by the lower face 28 of a work station positioner 30, which is arcuately displaceable over the die plate and positionable in timed relationship with the press drive by being mounted on the end of a support arm 31 arcuately movable by a drive mechanism 33. The work station positioner 30, FIGS. 3 and 4, is provided with a powder dispenser, an anvil and a part ejection pick-up head arranged as explained, for example in U.S. Pat. Nos. 3,730,659, 3,726,622 and 3,415,142.

Figure 2:
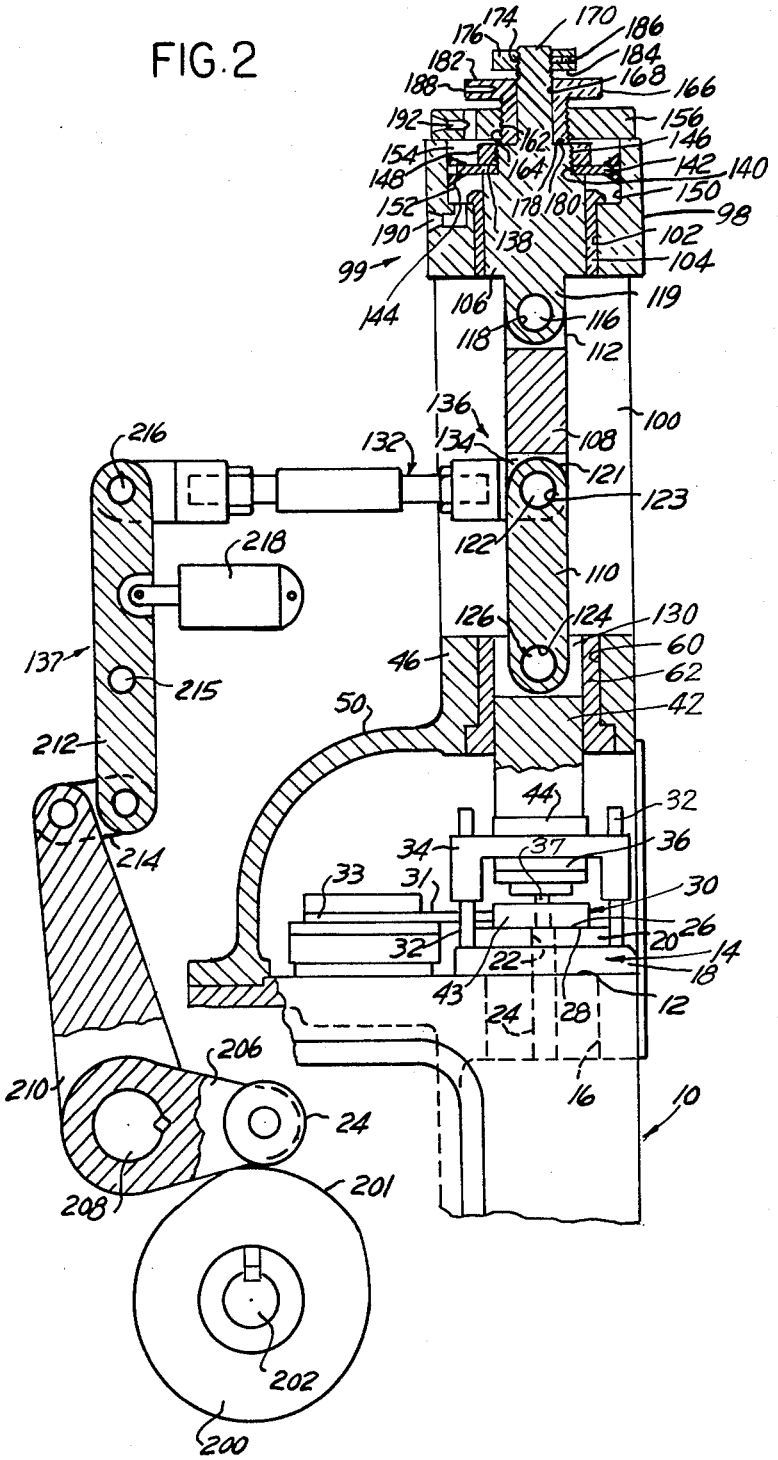
FIG. 2 is a view similar to FIG. 1, but showing the relative position of the diverse elements during press dwell.

As shown at FIGS. 1 and 2, the die plate spacer 18 has a pair of vertically extending columns 32 on which is slidably mounted a reciprocable saddle 34. A block 36 is fastened on the bottom of the saddle 34, the block 36 forming a holder for upper punches, one of which is shown at 37, in arrangements where it is desired to provide the powder compacting punch and die assembly 14 of the press with upper punches, or a holder for a platen 38, in the example of structure illustrated at FIGS. 3–4, adapted to engage the clamping block 40 of the anvil 41 included in the work station positioner 30. In structures where upper punches are not used, the saddle 34 and the columns 32 may be omitted, FIGS. 1–2, and the anvil entirely omitted or replaced by an upper punch guideblock, as shown at 43.

A ram 42 has an end 44 fastened to the top of the saddle 34 for reciprocating the saddle toward and away from the die plate 20, FIGS. 1–2, or fastened to the anvil clamping platen 38, FIGS. 3–4. The ram 42 is slidably supported by a housing 46. The housing 46 is mounted above the press table 12 by means of appropriate support members such as 50.

For the purpose of slidably supporting the ram 42, the housing 46 has a bore 60 in which is fitted a bearing 62, which may be of the type disclosed in details in U.S. Pat. Nos. 4,166,716 and 4,302,412.

The housing 46 supports the housing 98 of a fluid cylinder 99, in spaced-away aligned relationship, by way of a pair of side plates 100 having their lower edge welded to or cast with the top of the housing 46 and their upper edge welded to, or cast with, the bottom of the cylinder housing 98. The cylinder housing 98 has an open end forming a bore 102 provided with a bronze, or other low friction material, bushing 104 press-fitted or otherwise mounted in the bore 102. The bushing 104 forms a linear bearing for a slide 106 reciprocable therein. The end of the slide 106 projecting at the bottom of the cylinder housing 98 is connected by means of a pair of pivoting articulated connecting rods 108 and 110 to the top of the ram 42. The connecting rod 108 is provided with a first bifurcated end 112 having a transverse bore in which is press-fitted a pin 116 passing through a transverse aligned bore 118, formed in the projecting end 119 of the slide 106, the projecting end 119 having a width fitting between the parallel bifurcated portions 112 of the connecting rod 108. The other end of the connecting rod 108 has a similarly bifurcated portion 121 provided with a transverse bore through which is press-fitted a pin 122 which forms a pivoting connection between the connecting rod 108 and the connecting rod 110, the appropriate end of the connecting rod 110 being provided with a bore 123 pivotably accepting therethrough the pin 122. In a similar manner, the other end of the connecting rod 110 has a transverse bore 124 pivotably accepting a pin 126 press-fitted into a corresponding transverse bore formed in the upper end of the ram 42 which has a bifurcated portion 130 accepting therebetween the end of the connecting rod 110.

A toggle actuating push-pull rod 132 is also pivotably connected to the intermediary pin 122 by means of its bifurcated end 134, each portion of the bifurcated end 134 being provided with a bore pivotably accepting an end of the pin 122. The push-pull rod 132 and the connecting rods 108 and 110 form in combination the toggle mechanism 136 whose function it is to mechanically reciprocate the ram 42 up and down relative to the housing 46, by means of an appropriate linkage lever and cam arrangement 137 causing the rod 132 to be displaced from the position shown at FIGS. 1 and 3, whose position is representative of the top dwell position of the ram 42, to the position shown at FIGS. 2 and 4, which represents the bottom dwell position, or press position, of the ram 42.

The upper end of the slide 106 has a reduced diameter portion 138 over which fits an aperture 140 formed in a disk-shaped piston member 142 provided at its edge with a pair of annular elastomeric sealing rings 44. A portion of the reduced diameter portion 138 of the slide 106 is provided with a thread, as shown at 146, over which is threaded a retaining nut 148, holding the piston disk 142 in position on the slide 106. The piston disk 142 extends within an enlarged bore 150 formed concentric with the bore 102 of the cylinder housing 98, and the piston disk 142, together with the sealing rings 144, forms a separation between a lower chamber 152 and an upper chamber 154 thus defined in the cylinder bore 150.

The chamber 154 is closed by an end plate 156 fastened on the upper end face of the cylinder housing 98. The end plate 156 has a centrally located internally threaded bore 162 through which is threaded the reduced diameter portion 164 of a flanged plug 166. The flanged plug 166 has an internal bore 168 slidably accepting a further reduced diameter projecting end portion 170 of the slide 106. The extreme end of the reduced diameter portion 170 is provided with a thread, as shown at 174, threadedly accepting a collar 176 thereabout.

An annular shoulder 178, formed between the intermediary reduced diameter portion 138 of the slide 106 and the projecting reduced diameter end portion 170 thereof, defines an abutment engageable with the end 180 of the flanged plug 166. In a similar manner, the end face 182 of the flange portion of the flanged plug 166 forms an abutment engageable with the lower annular surface 184 of the collar 176. As the collar 176 is longitudinally adjustably positionable along the threaded portion 174 of the reduced diameter portion 170 of the slide 106, which position may be secured and maintained by means of tightening one or more set screws such as set screw 186 radially disposed through the collar 176, and as the flanged plug 166 is adjustably threadably positionable in and out of the cylinder end plate 156, any downward motion of the piston 142 and consequently of the slide 106 is limited as soon as the abutments 182 and 184 engage. Any upward motion of the slide 106 is adjustably limited as soon as its shoulder 178 engages the end face 180 of the flange plug 166. Radial apertures, such as radial apertures 188, are formed in the flange portion of the flanged plug 166, to permit adjustment of the longitudinal position of the flanged plug 166 by rotating the flanged plug by means of a steel rod, or other tool, introduced through an aperture 188 to apply a torque rotating the flanged plug 166.

The piston 142, and consequently the slide 106, may be reciprocated by introducing and exhausting pressurized fluid into and from the chambers 152 and 154 by means of, respectively, ports 190 and 192. When pressurized fluid is introduced into the chamber 152 through port 190, while at the same time fluid is exhausted from the chamber 154 through port 192, the piston 142, and consequently the slide 106, is displaced upwardly until the abutments 178 and 180 engage, as shown at FIGS. 1 and 2. When pressurized fluid is introduced into the chamber 154 through the port 192, while fluid is exhausted from the chamber 152 through the port 190, the piston 142 and the slide 106 are displaced downwardly, thus separating the abutment 178 from the abutment 180, until the abutments 182 and 184 engage. The displacement of the slide 106 thus displaces the upper fulcrum point of the toggle mechanism which corresponds to the pivoting pin 116, thus causing the ram 42 to be displaced or positioned downwardly further than the downward displacement resulting from the toggle mechanism 136 at its lower dwell position. Conversely, the upward displacement of the slide 106, resulting from the upward displacement of the piston 142, causes in turn an upward displacement of the pivot pin 116 which in turn causes an upward displacement of the ram 42.

The stroke of the ram 42 resulting from the operation of the piston 142 in the fluid cylinder 99, and the upper and lower extreme positions of the slide 106, are determined by the adjustment of the flanged plug 166 and of the collar 176. The pressurized fluid used for reciprocating the piston 142 may be a hydraulic fluid or a pneumatic fluid, such as compressed air, where it is desired to take advantage of the cushioning effect of a pneumatic system. The valve, not shown, used for introducing and exhausting fluid respectively into and from the chambers 152 and 154 through the ports 190 and 192 is operated by an appropriate adjustable cam on the drive mechanism of the press, such that the operation of the fluid cylinder may be adjustably timed to occur at any portion of the cycle of operation of the ram 42 caused by the toggle mechanism 136, or at the end of such cycle, at the beginning of such cycle, or at any other time. The direction of displacement of the piston 142, and therefore of the slide 106 may be the same as the direction of displacement of the ram 42 which is caused by the toggle mechanism 136, or it may be in an opposite direction.

When it is desired to render inoperative the hydraulic or pneumatic operation of the slide 106, the collar 176 is adjusted such that its abutting annular surface 184 engages the annular end surface 182 of the flanged plug 166, the flanged plug 166 having been first adjusted such that its end face abutment 180 engages the shoulder abutment 178 of the slide. In this manner, the fulcrum axis of the pin 116 may be adjusted up and down to any fixed reference position, within the range provided by the adjusting mechanism. Once a fixed adjustment is provided, the ports 190 and 192 may be disconnected from the source of pressurized fluid, thus disabling the fluid operation of the ram.

In addition to providing for ease of adjustment of a reference position for the ram 42, and in addition to providing auxiliary means for operating the ram 42, in co-operation with the toggle mechanism 136, the mechanism presents the further advantage of providing added flexibility for the reciprocating motion of the ram 42, and by appropriate timing, of providing compound or successive motions of the ram, one by the mechanical means provided by the toggle mechanism and the other by the auxiliary means provided by the fluid-operated ram actuator. An example of such advantage is to provide a cushioned, more particularly when pneumatic fluid is used, actuation of the piston 142 and therefore of the slide 106 and ram 42 either for clamping the anvil 41 on the top surface 26 of the die plate 20, FIG. 4, or for actuating the upper punches when the ram 42 is used for actuating either independent upper punches such as punch 37 of FIGS. 1–2 or upper punches built in the anvil as disclosed for example in U.S. Pat. No. 3,775,032.

The toggle mechanism 136 is operated by an arm and link mechanism 137 from a cam 200 keyed on the camshaft 202 of the press apparatus and rotating in the direction of the arrow. A second cam, not shown, operating a treadle mechanism, not shown, for reciprocating the lower punch or punches 24 is also mounted on the camshaft 202. The arm and link mechanism 137 comprises a cam follower 204 rotatably mounted on one end of an arm 206 rigidly connected through a pivot shaft 208 to a second arm 210, such that when the lobe 201 of the cam 200 lifts the cam follower 204 and swings the arm 206 from the position of FIGS. 1 and 3 to the position of FIGS. 2 and 4, the free end of the arm 210 is swung leftwardly, as seen in the drawing, to the position of FIGS. 2 and 4. The end of the arm 210 is pivotably connected to a swing arm 212 by means of a link 214, such that the swing arm 212 is pivoted around its pivot 215 from the position indicated at FIGS. 1 and 3 to the position indicated at FIGS. 2 and 4. The other end of the swing arm 212 is pivotably attached by means of a pin 216 to the end of the pull-push rod 132, pivotably attached in turn at its end to the articulated connection between the ram connecting rods 108 and 110. In this manner, the toggle mechanism 136 is actuated by the cam 200 from a position lifting the ram 42 away from the die plate surface 26, FIGS. 1 and 3, to a position wherein the connecting rods 108 and 110 are substantially aligned and the ram 42 is positioned at its low dwell position, FIGS. 2 and 4. An air spring 218 counterbalances the weight of the movable parts and the weight of the ram 42, and constantly urges the cam follower 204 in engagement with the surface of the cam 200. The push-pull rod 132 is adjustable in length.

The permissible stroke of the toggle mechanism upper slide 106 is adjusted by adjusting the position of the collar 176 and the position of the sleeve 174, as previously mentioned. Fluid under pressure, preferably compressible fluid such as a gaseous fluid fills the chamber 154 on the top side of the piston 142, such as to cause the bottom surface 184 of the collar 176 to abut the upper surface 182 of the flange portion of the flanged plug 166, and to cause a clearance to exist between the abutments 178 and 180, as shown at FIGS. 1 and 3. The pressure of the fluid in the chamber 154 may be such as to apply any appropriate force to the end 119 of the slide 106, which must be overcome by the toggle mechanism when the connecting rod 108 and 110 are aligned and the ram 42 is exerting full pressure to compact an article in the die cavity by means of the punch 37, at FIG. 2, or to clamp the anvil 41, FIG. 4, at the press dwell position of the ram 42 causing the abutments 178 and 180 in the cylinder 99 to engage. For example, in a six-ton press, that is a press capable of developing a force of 6 tons at the ram 42 either for clamping an anvil or for compacting by means of an upper punch or punches powder material in a die cavity, the pressure of the fluid in the chamber 154, the chamber 152 being connected to ambient through the port 190, may be adjusted such as to provide any appropriate force at the ram 42, up to 6 tons if so desired, but preferably, for most practical applications, in the range of 0.5 to 2 tons.

Figure 5:
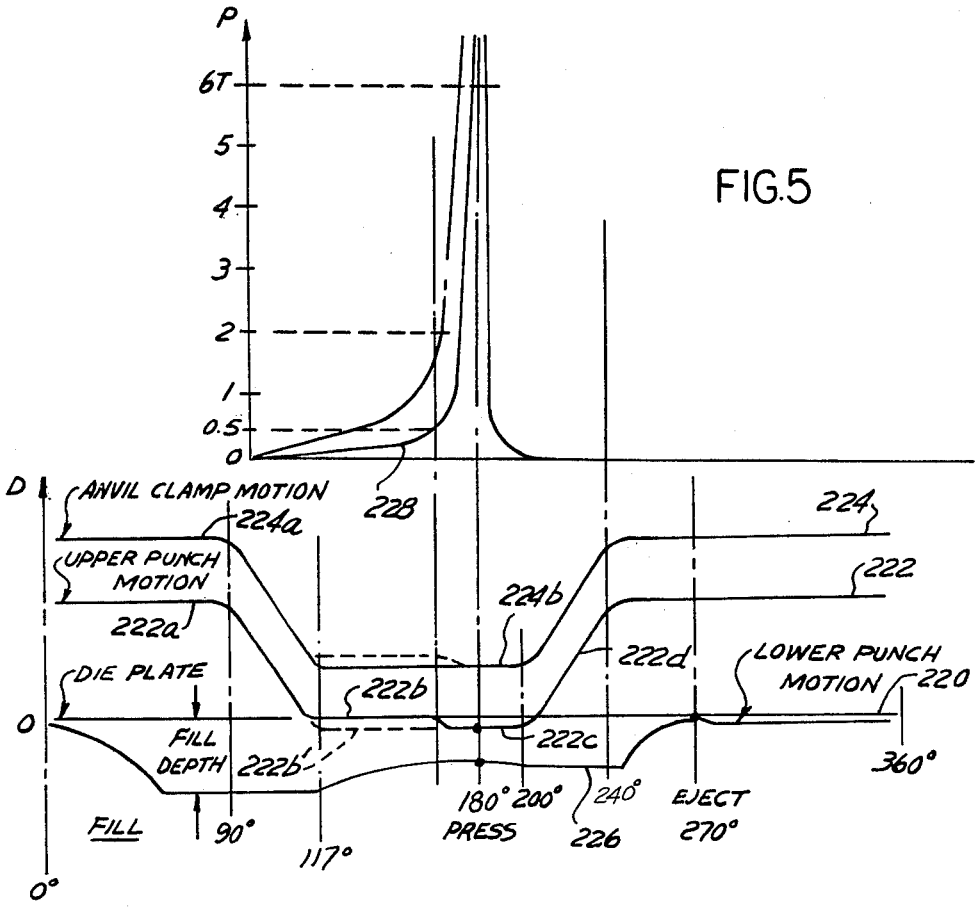
FIG. 5 is a diagram of motion and pressure exerted by the upper ram of a press according to the present invention in appropriate timing with the motions of the lower punch.

The diagram of FIG. 5 shows at 220 the level of the die plate surface 26. Curve 222 graphically illustrates the displacement of the face of the upper punch 37, FIGS. 1 and 2, relative to the level 220 of the die plate surface, while curve 224 depicts graphically the motion of the anvil clamp plate 38, FIGS. 3 and 4, mounted on the end of the ram 42 for anvil pressing operations. Curves 222 and 224 are shown relative to a curve 226 representing the corresponding motions of the face of the lower punch 24, relative to the die plate surface 220. The curves 222, 224 and 226 represent the relative positions of the elements in ordinate as a function of the angular position from 0° to 360° of the cam 200, FIGS. 1–4, whose contour is shown in more detail at FIG. 6.

Figure 6:
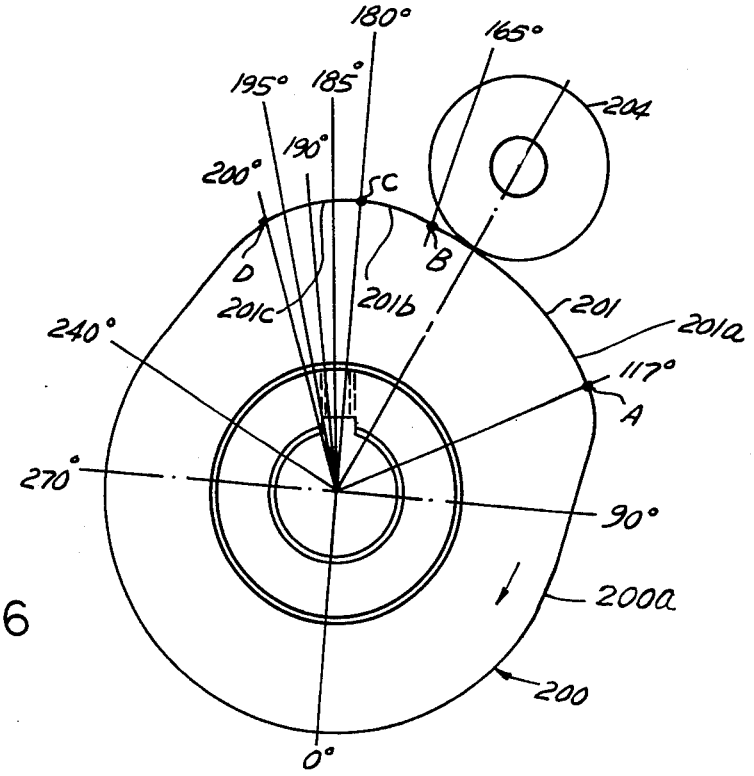
FIG. 6 is a schematic detailed representation of an appropriate cam contour for operating the press toggle mechanism effectively for either anvil pressing or upper punch pressing.

The diagram of FIG. 5, and the contour representation of the cam 200 of FIG. 6 illustrate clearly how the same cam may be used, in conjunction with the fluid cylinder 99 providing the top anchoring point of the toggle mechanism 136 actuating the ram 42, to effectuate pressing operation by means of upper punches or for effecting pressing operation against the surface of an anvil. From the 0° angular position of the cam 200, FIG. 6, to approximately the 90° angular position, the cam follower 204 is riding on the low circular portion **200*a* of the cam 200, with the result that the position of the toggle mechanism 136 is that of FIGS. 1 and 3, thus lifting the ram 42** away from the die plate surface.

During subsequent rotation of the cam 200, from the 90° angular position to the 117° angular position, point A, the portion **201*a* of the lobe 201 of the cam 20 begins to lift the cam follower 204. With the press apparatus operating in opposed punch pressing mode, i.e. with the ram 42 carrying on its end 44 an upper punch 37, the face of the upper punch 37 is brought from a high position shown at 222*a* at FIG. 5 to a position flush with the die plate level as shown at 222*b*. Such a position correspond to that illustrated at FIG. 2, but with the pressure of the fluid in the chamber 154 being such that the abutments 178 and 180 in the cylinder 99 are still separated as illustrated at FIG. 1. The connecting rod 108 and 110 of the toggle mechanism 136 almost are, but not quite, in alignment. The pressure exerted on the end of the upper punch 37, which is now closing the die cavity, corresponds to the force developed by the fluid cylinder 99, as a result of the fluid under pressure being present in the chamber 154. The lower punch 24 is simultaneously being displaced from its lowest, or fill, position towards its top dwell position, thus compacting the powder material between the face of the lower punch and the face of the upper punch in the die cavity. The pressure of the fluid in the chamber 154 of the cylinder 99, has been preadjusted during set-up such as to provide enough pressure or force, for example up to 2 tons, on the ram 42 and consequently on the upper punch 37. At approximately 165° of the angular position of the cam 200, or point B at FIG. 6, the cam follower 204 starts to ride on the portion 201*b* of the cam lobe 201 between points B and C, with the result that the connecting rods 108 and 110, FIGS. 1–4, become aligned, as shown at FIG. 2, and the end face of the punch 37 is displaced downwardly into the die cavity, as shown at portion 222*c* of curve 222, FIG. 5, while the lower punch is still being displaced upwardly to its top dead center occurring approximately at the 180° angular position of the cam 200. Simultaneously, the slide 106 is being displaced upwardly against the pressure of the fluid in chamber 154 until the abutments 178 and 180 are solidly in engagement with each other. The full force imparted upon the upper punch 37 by the ram 42** is thus the full force exerted by the press apparatus, or six tons according to the arbitrarily chosen numerical example.

Further rotation of the cam 200 causes the cam follower 204 to start receding by travelling along the portion **201*c*, between points C and D of the lobe 201, approximately until the cam 200 reaches the 200° angular position. Although the force exerted by the ram 42 upon the upper punch 37 progressively decreases, the upper punch remains substantially in the same position within the die cavity until the cam 200 reaches its 200° angular position, because the lower punch is also progressively decreasing the upwardly directed force it exerts on the face of the upper punch. When the cam 200 reaches its 200° angular position the ram 42, and consequently the upper punch 37, are caused to be retracted, according to curve 222***d* of FIG. 5. When the cam 200 has been rotated to its 240° angular position, the ram 42 is in its fully retracted position, FIG. 1, thus fully retracting the upper punch 37. Simultaneously therewith the pressure of the fluid in the chamber 154 of the fluid cylinder 99 has displaced the piston 142 downwardly, thus re-establishing the clearance between the abutments 178 and 180 and causing the collar 176 to engage the upper face of the flanged plug 166.

The force developed by the ram 42 is, as shown by curve 228 of FIG. 5, increasing asymptotically from zero to a maximum which, in the arbitrarily chosen example, is about six tons, until at the dwell press position of the lower punch, the pressure or force developed is maximum. It can be seen from the diagram of FIG. 5 that a portion of the force exerted by the ram, and consequently exerted by the upper punch 37 is obtained from the fluid cylinder 99, for example 0.5 ton, while the rest of the force is exerted by the mechanical toggle mechanism 136. If it is desired to move the upper punch into the die cavity, the pressure in the fluid cylinder 99 may be adjusted such as to cause penetration of the upper punch 37 into the die cavity as shown in dotted line at portion 222*b*. For example, a force of 2 tons may be chosen to be exerted by the cylinder 99 upon the ram 42 prior to progressively increasing the force exerted by the mechanical toggle mechanism 136.

Because the structure of the invention enables a portion of the pressure exerted by the ram 42 to be obtained from the fluid cylinder 99, the same cam contour, as shown at FIG. 6, may be used for effecting pressing of an article against the face of an anvil, as represented at FIGS. 3–4. Referring once again to FIG. 5, the anvil clamp motion curve 224 is the same and parallel to the curve 222 representing the upper punch motion hereinbefore described. At the 117° angular position of the cam 200, the clamping plate 38 mounted on the end of the ram 42 is in engagement with the clamping block 40 of the anvil 41, FIGS. 2 and 4. The pressure exerted on the anvil 41 is that obtained from the fluid cylinder 99, which is enough to hold the anvil over the die cavity while the lower punch is caused to reciprocate upwardly to compress the powder material in the die cavity between the face of the lower punch and the anvil face. As the lower punch approaches its dwell position of maximum compacting force, the force exerted on the anvil 41 by the ram 42, which is obtained from the fluid cylinder 99, becomes insufficient to prevent the anvil from being lifted from the surface of the die plate. However, at the 165° angular position of the cam 200, the connecting rods 108 and 110 are rapidly brought into alignment, thus overcoming the pressure developed in the chamber 154 of the fluid cylinder 99, with the result that the abutments 178 and 180 become engaged and the full force developed by the mechanical toggle mechanism 136 upon the ram 42 is exerted upon the anvil 41, thus preventing it from being lifted from above the die plate surface, as shown at portion 224*b* of curve 224, FIG. 5.

It can thus be seen that a powder compacting press provided with a mechanical toggle mechanism and an auxiliary fluid actuated mechanism disposed in series with the mechanical toggle mechanism displacing the ram of the press permits the press to operate as an anvil pressing press or as an opposed punch pressing press, without requiring different cam contours and therefore without changing the cam operating the toggle mechanism of the ram.

Having thus described the invention by way of examples of structure well designed for practicing the invention, modifications whereof will be apparent to those skilled in the art, what is claimed as new is as follows:

1. A powder compacting press comprising a table, a ram reciprocably movable relative to said table, first means for reciprocating said ram comprising a first connecting rod having an end pivotably attached to an end of said ram, a second connecting rod having an end pivotably attached to the other end of said first connecting rod and another end pivotably attached to a slide member and a push-pull rod pivotably attached at one end to said pivotable connection between said first and second connecting rods for displacing said pivotable connection to a position laterally moving said pivotable connection for displacing said ram away from said table to a position displacing said ram towards said table, a fluid cylinder having a movable member, said movable member being attached to said slide member, a pressurized fluid in said cylinder for displacing said movable member and said slide member in a first direction toward said table, first abutment means adjustably defining the extreme position of displacement of said slide member in said first direction, second abutment means adjustably defining the extreme position of motion of said slide member in an opposite direction, a rotating cam operating said push-pull rod, said cam having a lobe contour causing displacement of said ram to a predetermined position most proximate to said table with the pressure in said cylinder counterbalancing a force exerted on said ram in an opposite direction and for abruptly increasing the force exerted on said ram in response to increase of said force in an opposite direction, whereby said second abutment means engage each other.

2. The powder compacting press of claim 1 wherein a punch is mounted on the end of said ram for compacting powder material in a die cavity disposed in said table.

3. The powder compacting press of claim 1 wherein a clamping plate is mounted on the end of said ram for engagement with the top of an anvil positionable over a die cavity in said table.

4. A method of compacting powder material in a die cavity in which is disposed a reciprocable punch, said method comprising placing a wall over said die cavity and reciprocating said punch towards said wall, applying a progressively increasing force upon said wall for counterbalancing the force exerted upon said wall by said reciprocating punch being displaced toward said wall, wherein said force applied to said wall is first obtained from a fluid cylinder at the beginning of the reciprocation of said punch and by a mechanical toggle mechanism prior to the force exerted by said reciprocating punch upon said wall exceeding the force exerted by said fluid cylinder on said wall.

5. The method of claim 4 wherein said solid wall is a face of an anvil overlapping said die cavity.

6. The method of claim 4 wherein said wall is an end face of a punch mounted on said ram.

* * * * *

UNITED STATES PATENT AND TRADEMARK OFFICE

CERTIFICATE OF CORRECTION

PATENT NO. : 4,376,744

DATED : March 15, 1983

INVENTOR(S) : Raymond P. DeSantis

It is certified that error appears in the above–identified patent and that said Letters Patent are hereby corrected as shown below:

Col. 2, line 19, change "arm" to --ram--.

Col. 10, line 67, delete "said", after "on" insert --a reciprocable--.

Signed and Sealed this

*Thirty-first* Day of *May 1983*

[SEAL]

*Attest:*

DONALD J. QUIGG

*Attesting Officer*

*Acting Commissioner of Patents and Trademarks*